US005333368A

United States Patent [19]

Kriener et al.

[11] Patent Number: 5,333,368

[45] Date of Patent: Aug. 2, 1994

[54] CHAIR CONTROL WITH FORWARD TILT

[75] Inventors: Michael Kriener, Ahlen; Johannes Uhlenbrock, Drensteinfurt, both of Fed. Rep. of Germany; Larry A. Wilkerson, Comstock Park; Richard N. Roslund, Jr., Georgetown Township, Ottawa County, both of Mich.

[73] Assignee: Haworth, Inc., Holland, Mich.

[21] Appl. No.: 972,951

[22] Filed: Nov. 6, 1992

Related U.S. Application Data

[63] Continuation-in-part of Ser. No. 940,923, Sep. 8, 1992, abandoned.

[51] Int. Cl.[5] ..... A47C 1/024

[52] U.S. Cl. ..... 297/301; 297/302; 297/304

[58] Field of Search ..... 297/301, 302, 304

[56] References Cited

U.S. PATENT DOCUMENTS

| | | | |
|---|---|---|---|
| 180,548 | 8/1876 | Chichester . | |
| 3,741,607 | 6/1973 | Cramer | 297/302 |
| 4,198,094 | 4/1980 | Bjerknes et al. | 297/328 |
| 4,830,431 | 5/1989 | Inoue | 297/304 X |
| 4,852,943 | 8/1989 | Roper | 297/302 |
| 4,892,354 | 1/1990 | Estkowski | 297/302 X |
| 5,009,466 | 4/1991 | Perry | 297/301 X |
| 5,102,196 | 4/1992 | Kaneda et al. | 297/301 X |

*Primary Examiner*—Peter R. Brown

*Attorney, Agent, or Firm*—Flynn, Thiel, Boutell & Tanis

[57] ABSTRACT

An office-type chair having a base, a cantilevered pedestal assembly projecting upwardly from substantially a center of the base, and a seat/back arrangement connected to an upper end of the pedestal assembly. The seat/back arrangement includes a generally horizontally enlarged seat assembly and a back assembly projecting upwardly from and adjacent a rear edge of the seat assembly. The seat/back arrangement also includes a rear tilt control mechanism for normally permitting the seat/back arrangement to be vertically tilted rearwardly against the urging of a resilient biasing element away from a normal upright position into a rearwardly tilted position. A front tilt mechanism cooperates between the pedestal assembly and the seat assembly for permitting the entire seat/back arrangement to be vertically tilted forwardly away from the normal upright position so that the seat assembly declines in a forward direction. The forward tilt mechanism is independent of the rear tilt control.

20 Claims, 7 Drawing Sheets

CHAIR CONTROL WITH FORWARD TILT

CROSS REFERENCE TO RELATED APPLICATION

This application is a continuation-in-part of copending application Ser. No. 07/940,923 filed on Sept. 8, 1992 now abandoned.

FIELD OF THE INVENTION

This invention relates to a chair, such as an office chair, having a chair control which permits rearward tilting of the seat and back relative to the base, and which additionally incorporates a forward tilt mechanism to selectively enable the chair seat to be forwardly tilted and secured in such forward tilted position.

BACKGROUND OF THE INVENTION

Office chairs conventionally provide for rearward vertical tilting of the seat and back relative to the chair base, with the seat/back typically being urged by springs into a normal upright position wherein the seat extends approximately horizontal or is slanted rearwardly at a small angle. In such chairs, a tilt control mechanism typically permits the occupant to push against the back to cause rearward titling of the back and/or seat against the urging of the spring. Chairs having such construction are conventional, and have been utilized in offices and other environments for many years.

This invention relates to a chair of the general type described above, but which additionally includes a forward tilt control to enable the chair seat to be tilted forwardly from its normal approximately horizontal position. That is, by suitable adjustment of a mechanism which cooperates between the base and a part of the chair seat, the chair seat can be vertically tilted so that the front edge thereof is moved downwardly to cause the chair seat to assume a forwardly declining relationship relative to the floor. The mechanism permits such forward decline to be individually selected over a predetermined range, and lockingly maintains the chair seat in the selected forwardly declined position. When so disposed, the seat/back arrangement still retains its normal rearward tilting capability, which capability is now initiated starting from the selected forward tilt position.

Figure 1:
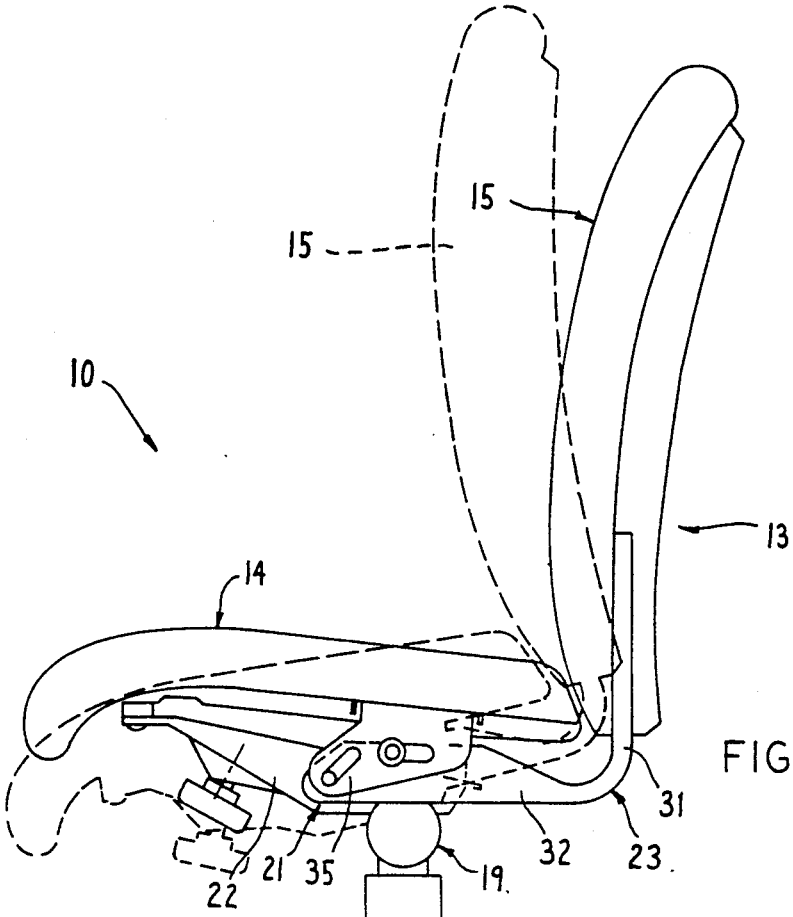
FIG. 1 is a fragmentary side view of an office-type chair illustrated in its normal upright (i.e. unoccupied) position.

Certain terminology will be used in the following description for convenience in reference only, and will not be limiting. For example, the words "upwardly", "downwardly", "rightwardly" and "leftwardly" will refer to directions in the drawings to which reference is made. The word "front" will refer to the occupant entry side of the chair, namely the left side in FIGS. 1 and 2, and the word "rear" will refer to the side of the chair having the back thereon, this being the right side in FIGS. 1 and 2. The words "inwardly" and "outwardly" will refer to directions toward and away from, respectively, the geometric center of the chair and designated parts thereof. Said terminology will include the words specifically mentioned, derivatives thereof, and words of similar import.

DETAILED DESCRIPTION

Figure 2:
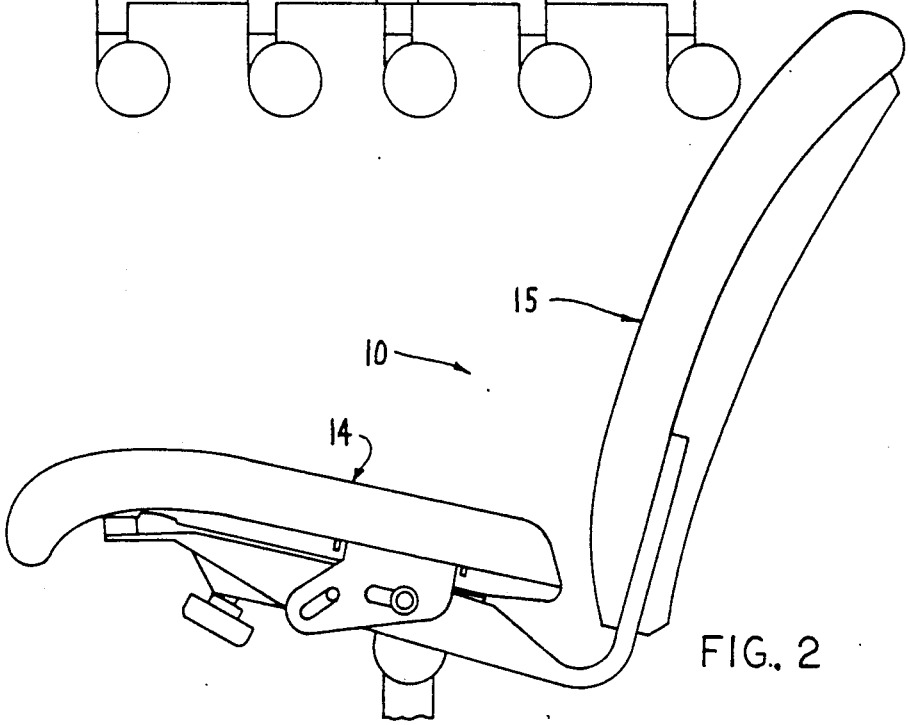
FIG. 2 is a view similar to FIG. 1 but illustrating the seat/back arrangement of the chair in a fully rearwardly tilted position.
Figure 3:
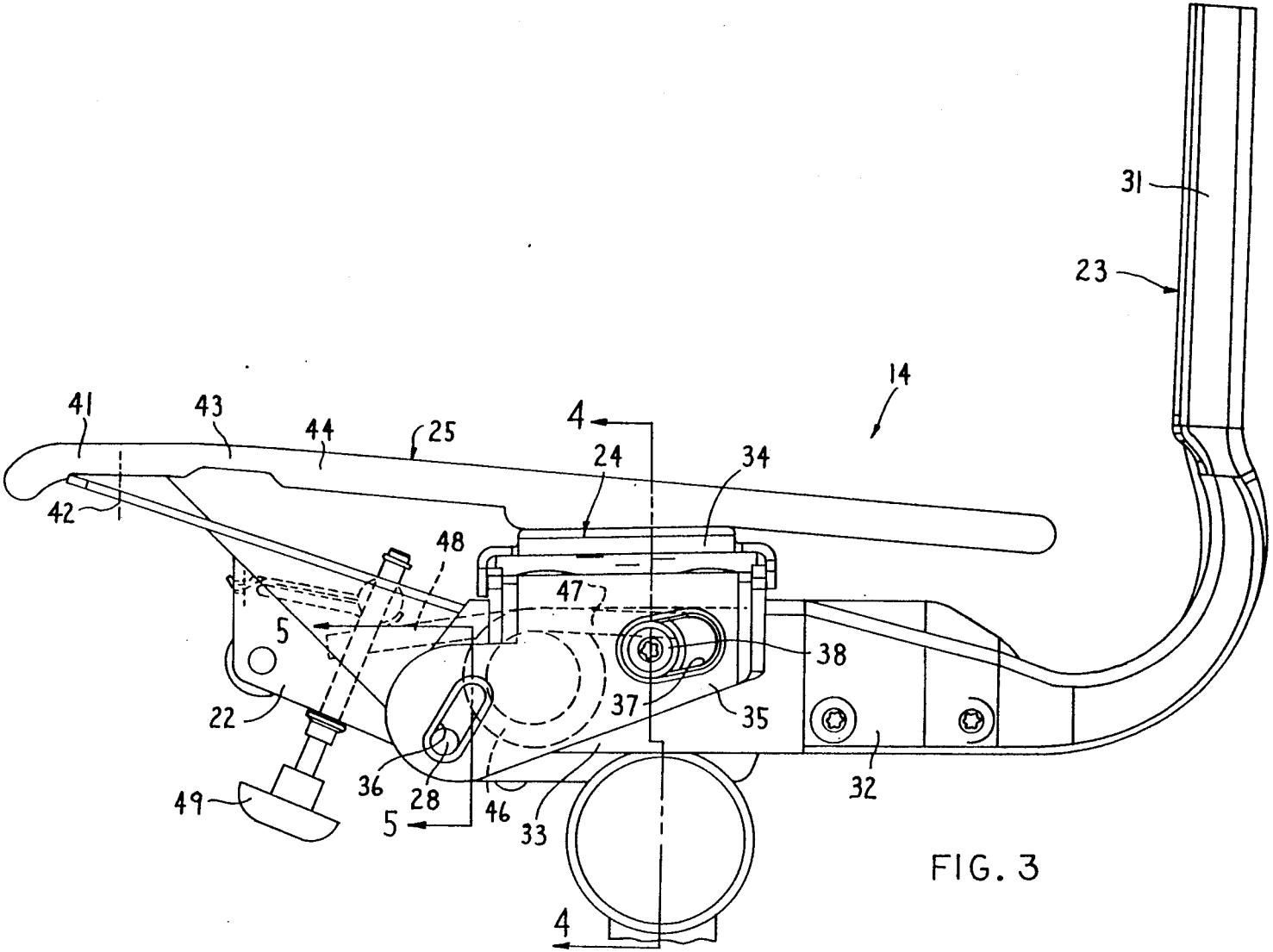
FIG. 3 is a fragmentary side elevational view illustrating the interior structure of the seat/back arrangement and its connection to the base.

Referring to FIGS. 1 and 2, there is illustrated an office-type chair 10 having a conventional base 11, the latter typically being a five-leg base provided with casters adjacent the ends of the legs. An upright pedestal assembly 12 is mounted centrally of the base 11 and projects generally vertically upwardly in cantilevered fashion, with the upper end of the pedestal assembly being joined to a seat/back arrangement 13. This arrangement 13 includes a generally horizontally enlarged seat assembly 14 which, adjacent its rearward edge, is joined to a generally upwardly extending back assembly 15.

The pedestal assembly 12 normally couples generally centrally to the underside of the seat assembly 14. This pedestal assembly 12 also conventionally mounts therein a height-adjusting mechanism, either a mechanical or pneumatic mechanism, for permitting the height of the seat/back arrangement 13 to be selectively adjusted by the occupant. Such height-adjusting mechanisms are conventional, and are not described herein.

In the improved chair 10 of this invention, a forward tilt mechanism 19 is provided generally at the upper end of the pedestal assembly 12 for coupling the pedestal to the seat assembly 14. This forward tilt mechanism 19 enables the entire seat/back arrangement 13 to be angularly tilted forwardly away from the normal upright position shown by solid lines in FIG. 1 into a forward tilt position such as diagrammatically illustrated by dotted lines in FIG. 1, with the forward tilt mechanism 19 permitting the seat/back arrangement 13 to be maintained in this forward tilt position. This forward tilt mechanism 19 is explained in detail hereinafter.

The seat/back arrangement 13 also includes a rearward tilt control 21 for permitting the arrangement 13 to be angularly moved rearwardly away from the normal upright position of FIG. 1 into a rearwardly tilted position as indicated in FIG. 2. Such rearward tilting is normally induced by the chair occupant pushing backwardly against the back assembly 15 to move the seat/-back arrangement 13 rearwardly, which arrangement 13 is then normally spring-urged back to the normal upright position upon release of the occupant pressure. Office-type chairs are conventionally provided with rear tilt controls which enable the back, or the seat-back combination, to be tilted rearwardly by the occupant against the urging of a resilient restoring device.

In the chair 10 of the present invention, the seat/back arrangement 13 and the rearward tilt control 21 associated therewith include a lower seat body 22 which extends generally across the width of the seat assembly and projects rearwardly from adjacent the front edge of the seat assembly to a location disposed rearwardly of the pedestal 12. A back support 23 cooperates with the seat body 21 and includes portions disposed interiorly of both the seat and back assemblies. A seat bracket 24 is also disposed interiorly of the seat assembly and extends generally transversely thereof. The seat assembly also includes a generally horizontally enlarged seat pan or shell 25 which extends generally across the width and length of the seat assembly and is disposed above the lower body 22 and bracket 24. A cushion (not shown) is typically disposed on top of the seat pan 25, and a suitable upholstery-type covering (not shown) is wrapped around the seat assembly in a generally conventional manner. The lower side of the seat assembly is typically closed off by a separate shroud (not shown), such being conventional.

During normal usage of the chair, the lower seat body 22 is typically stationarily supported on the pedestal 12 through the intermediate forward tilt mechanism 19, the latter being maintained generally in a fixed or stationary position during normal occupancy of the chair. This lower seat body 22 has generally parallel sidewalls 27 disposed adjacent opposite sides of the seat assembly, which sidewalls mount thereon horizontally aligned hinge pins 28, the latter defining a generally horizontally extending hinge axis which projects sidewardly of the chair and is disposed adjacent the elevation of the seat assembly but positioned somewhat forwardly from the vertically extending centerline of the pedestal assembly 12. The back support 23, sometimes referred to as the "upright", is generally L-shaped and includes an upright part 31 which projects upwardly into the back assembly 15, and the lower end of this upright part 31 is joined through a generally 90° bend to a generally horizontal leg part 32 which projects forwardly into the seat assembly 14. This horizontal leg part 32, at the forward free end thereof, defines a pair of forwardly projecting parts 33 which are generally downwardly-opening channel parts which respectively straddle the sidewalls 27 and couple to the hinge pins 28. These hinge pins 28 hence define a horizontal hinge axis for permitting vertical tilting movement of the back support 23 relative to the lower seat body 22.

The seat bracket 24 includes an upper part 34 which is positioned directly above the horizontal leg part 32 of the back support 23, which upper bracket part 34 extends generally horizontally in the width direction of the seat assembly and, adjacent opposite sides of the seat assembly, has a pair of brackets 35 which are fixed to the upper part 34 and project downwardly therefrom. These brackets 35 are positioned adjacent and effectively straddle the outer sides of the channel parts 33. Each bracket 35 has a first slot 36 formed therethrough, the latter being forwardly inclined as it extends vertically downwardly. Each slot 36 slidably accommodates therein an outer projecting end of the respectively adjacent hinge pin 28.

Each bracket 35 also has a second slot 37 formed therein, this latter slot being elongated approximately horizontally and disposed rearwardly of the first slot 36. Slot 37 accommodates therein a roller 38 which can move longitudinally along the slot, which roller 38 is rollingly mounted on a hinge pin 39 which is fixed to and projects generally horizontally sidewardly from the adjacent channel part 33 of the back support 23.

Referring now to the seat pan or shell 25, it includes a narrow striplike front part 41 which extends sidewardly of the seat assembly and is fixedly secured to the front edge of the lower seat body 22, such as by screws or fasteners as indicated by line 42. The seat pan 25 includes a sidewardly extending hinge or flexing region 43 disposed directly rearwardly of the front part 41, and this flexing region 43 in turn joins to a main seat part 44 which extends rearwardly substantially coextensively of the seat assembly. This main seat part 44 bears on and is fixedly secured to the upper bracket part 34.

The seat pan 25 is formed generally in one piece of a plastic material, with the flexing region or strip 43 extending sidewardly across the entire width of the pan and being formed either of a different material or of reduced cross section (as by eliminating reinforcing ribs on the underside of this section) so as to enable this flexing region 43 to function in a manner similar to a spring or horizontal hinge to enable the main seat part 44 to move vertically relative to the narrow front part 41. By this construction, the flexing region 43 in effect defines a hinge for the seat part 44 which is disposed more closely adjacent the knees of the chair occupant, and at the same time the front edge of the chair as defined by the front part 41 does not move and hence does not tend to lift the occupant's feet upwardly from the floor when the remainder of the seat assembly is tilted downwardly.

The rearward tilt control 21 for the chair also includes a torsion spring 46 which normally urges the seat/back arrangement 13 into the normal upright position indicated by FIG. 1. This torsion spring has one leg 47 thereof anchored against the forward end of the horizontal leg part 32 of the back support 23, and has the other leg 48 thereof anchored to a manually-controlled adjusting mechanism 49 which is coupled to the lower seat body 22. This adjusting mechanism 49 is of generally conventional construction so that further detailed description thereof is believed unnecessary. The torsion spring 49 biases the back support 23, and the seat bracket 24, in an upward direction (i.e. in a counterclockwise direction about the hinge pins 28 in FIG. 1).

Figures 4, 5:
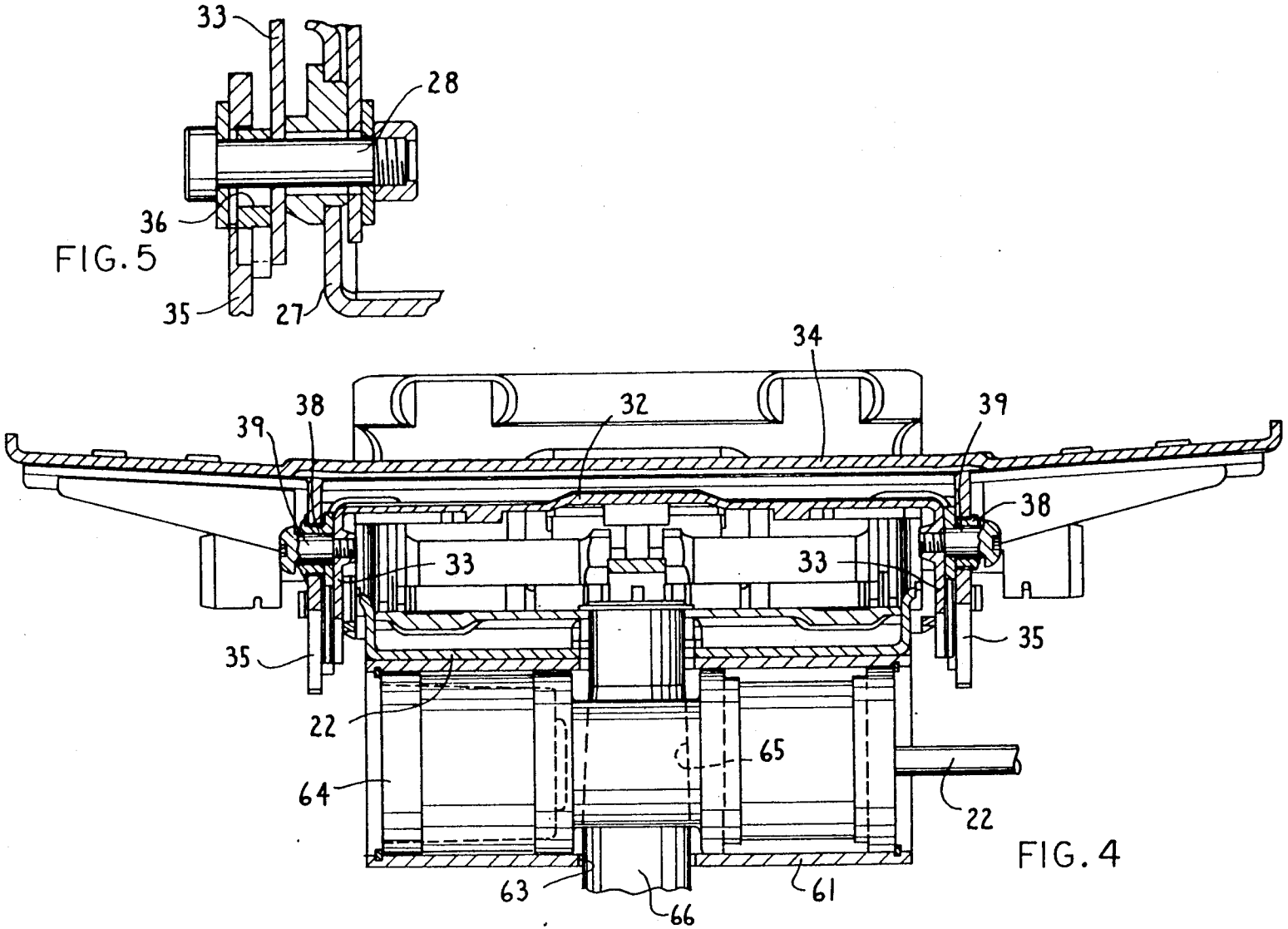
FIG. 4 is a fragmentary sectional view taken substantially along line 4—4 in FIG. 3.
FIG. 5 is a fragmentary sectional view taken substantially along line 5—5 in FIG. 3.
Figure 6:
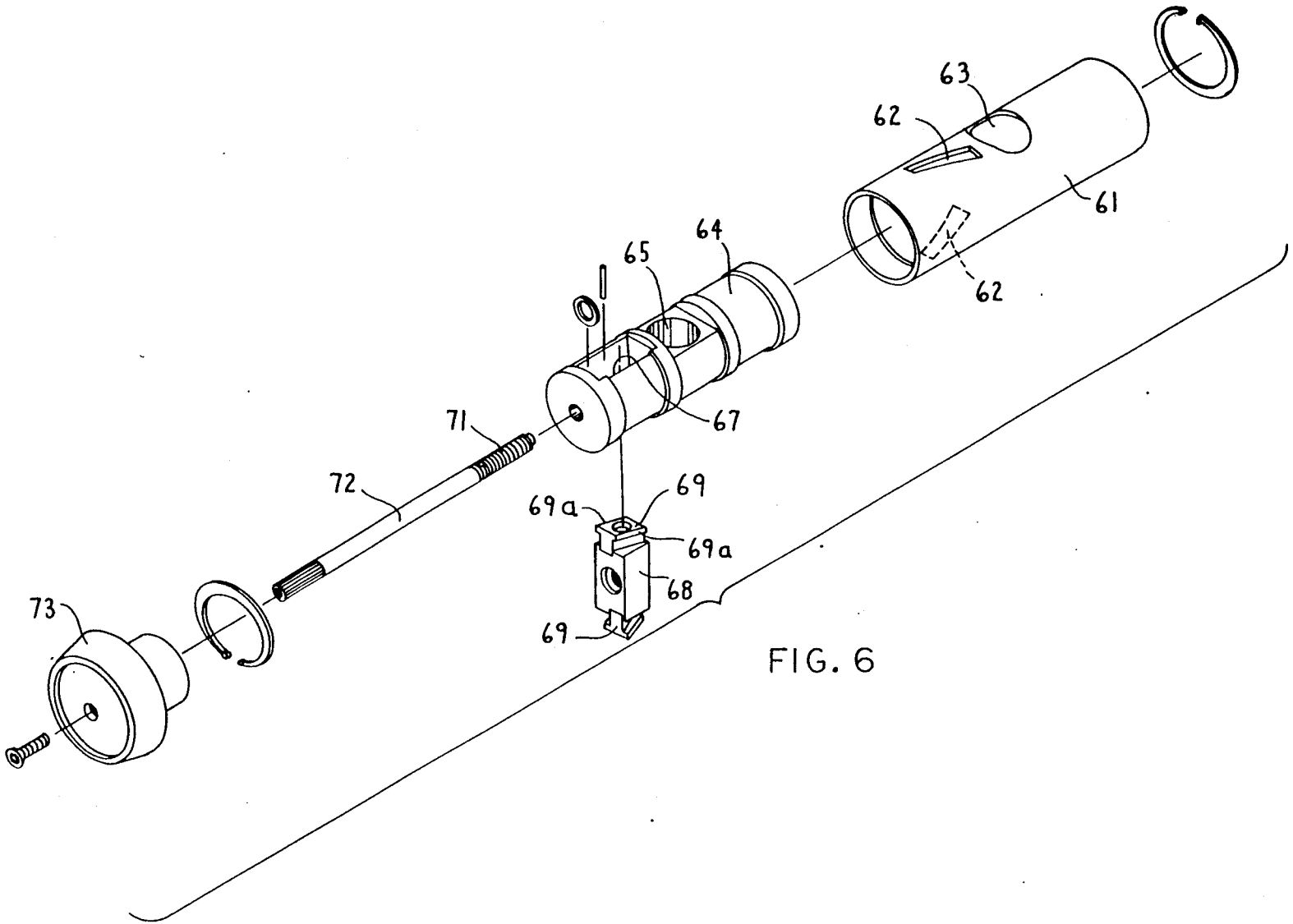
FIG. 6 is an exploded perspective view illustrating the components which comprise the forward tilt mechanism.
Figure 7:
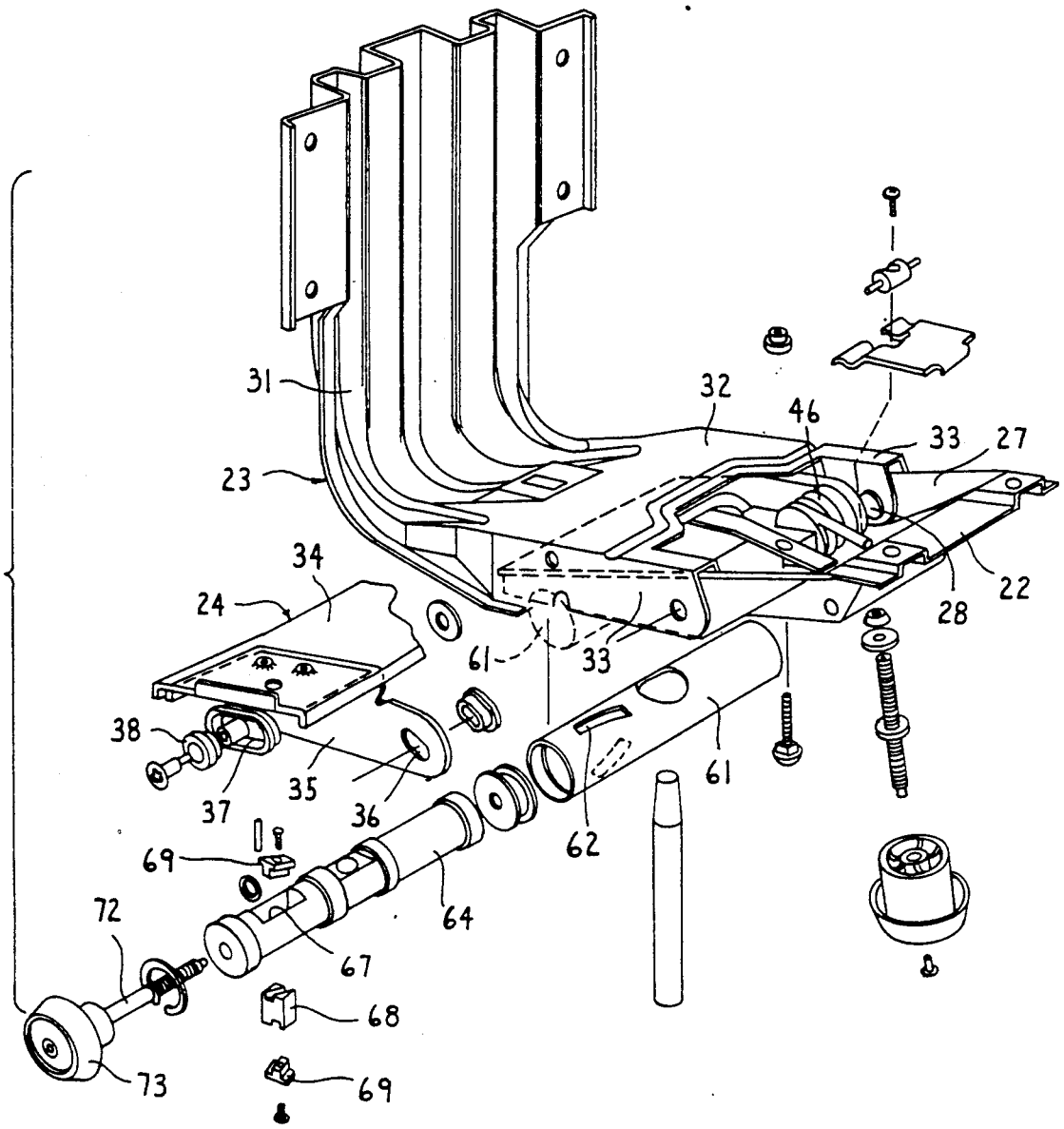
FIG. 7 is an exploded perspective view of the seat/-back arrangement illustrating the primary components thereof.

Considering now the forward tilt mechanism 19 and referring specifically to FIGS. 4 and 6, this mechanism includes a horizontally-elongate tubular cylindrical housing 61 which is provided with a pair of generally diametrically opposite slots 62 formed through the sidewall thereof, which slots 62 are formed generally on a helical or spiral pattern, but are of rather short length. The housing 61 also has a spindle-accommodating opening 63 extending through the sidewall thereof at a location substantially midway between the axial ends of the housing.

An elongate cylindrical support 64 is rotatably supported within the opening defined by the tubular housing 61. This cylindrical support 64 is axially restrained within the tubular opening by any conventional means, such as by snap rings. The cylindrical support 64 has a generally tapered opening 65 extending transversely therethrough, which opening 65 is aligned generally with the tube opening 63 and accommodates therein the upper tapered end of a spindle 66 associated with the pedestal assembly 12, which upper spindle end 66 has a wedge-type locking engagement within the tapered opening 65.

Cylindrical support 64 has a slot 67 formed therein, which slot is elongate in the axial direction of the cylindrical support, and opens radially outwardly through diametrically opposite sides of the cylindrical support. This slot 67 slidably accommodate therein a blocklike slide 68 which is of lesser length than the axial length of slot 67, whereby the blocklike slide 68 can be axially slidably displaced within the slot 67 along the axial direction of the cylindrical support 64. The slide 68 has a transverse length which substantially corresponds to the diameter of the cylindrical support 64, and guide blocks 69 are fixedly secured, as by fasteners such as screws, to opposite ends of the slide 68 whereby the guide blocks 69 project into and are slidably confined within the inclined slots 62 formed in the tubular housing 61. The guide blocks 69 have a width, as defined between opposed side edges 69*a* which are parallel but inclined relative to the axial direction, so as to be closely but slidably confined within the respective inclined slots 62 so as to be slidably displaceable therealong.

The blocklike slide 68 has a threaded opening extending coaxially therein, which opening is engaged with the threaded part 71 of an elongate spindle or shaft 72. This spindle 72 slidably and rotatably projects coaxially through an opening formed in an end portion of the cylindrical support 64 so as to project outwardly from one end of the tubular housing 61. A suitable gripping knob or handle 73 is fixedly secured to the outer end of the spindle 72, which knob is disposed under the seat assembly 14 more closely adjacent one side edge thereof so as to be readily accessible to an occupant of the chair when adjustment of the forward tilt mechanism 19 is desired.

The length of the slots 62 and the corresponding inclination thereof relative to the axial direction, coupled with the permissible axial stroke length of the slide block 68, is preferably selected so as to permit the seat/-back arrangement 13 to be forwardly tilted through an angle up to about 15° from the normal upright position illustrated in FIG. 1. Further, the angular inclination of the slots 62 relative to the axial direction is preferably selected to be a small slope or angle relative to the axial direction so that the engagement between the guide blocks 69 and the sidewalls of the slots 62 is such as to effectively create a self-locking relationship. That is, the adjustment mechanism 19 will remain in whatever position is selected by the occupant, and will remain locked in this position due to the engagement relationships created between the tube slots 62 and the guide blocks 69 provided on the slide 68. That is, loads imposed on this mechanism by the occupant are not able to induce undesired movement of the mechanism 19, and hence the preselected forward tilt position for the chair can be maintained.

The tilt operations of the chair 10 according to the present invention will now be briefly described.

The chair will typically be maintained in the normal upright position illustrated by solid lines in FIG. 1. In this latter position, the forward tilt mechanism 19 will be at one end position wherein the guide blocks 69 are disposed substantially adjacent one end of the inclined slots 62, and the torsion spring 46 will resiliently maintain the seat/back arrangement 13 in the normal upright position, in which position the roller 38 will substantially abut against one end of the slot 37 and the hinge pin 28 will substantially abut against one end of the slot 36.

When a person is seated in the chair, then the seat/-back arrangement 13 will tilt rearwardly a small amount relative to the normal upright position due to the weight of the occupant. Further, when occupying the chair, the occupant can selectively rearwardly tilt the seat/back arrangement merely by leaning backwardly into the chair so as to apply pressure against the back assembly 15. This causes the back support 23 to vertically pivot rearwardly about the hinge pins 28 and, due to the cooperation created by the roller 28 carried on the support back and its confinement within the slot 37, this causes a corresponding lowering of the main seat part 44 as permitted by flexing of the flexible or hinge region 43. During this rearward tilting of the back assembly 15 and downward tilting of a majority of the seat assembly 14, the front edge of the seat assembly 14 remains generally stationary inasmuch as the narrow front strip part 41 of the seat pan 25 is fixedly secured to the lower seat body 22, and the latter remains stationary during this occupant-induced rearward tilting movement.

Due to the manner in which the various aforementioned parts of the rearward tilt control cooperate, the back assembly 15 tilts rearwardly in a generally synchronized fashion with downward tilting of the seat assembly 14, although the back assembly tilts rearwardly at a significantly greater rate. For example, in a preferred embodiment of the invention, the back assembly has a maximum tilt angle of about 20°, and during movement of the back assembly through this maximum angle the seat assembly moves through a maximum downward tilt angle of about 8°.

When the occupant relieves pressure on the back assembly, then the torsion spring 46 automatically resiliently returns the back and seat assemblies to their original upright positions. Of course, it will be recognized that, if desired, a separate manually-actuated lock (not shown) can be provided so as to lock the seat/back arrangement 13 in any selected rearwardly tilted position.

If the chair occupant wishes to use the chair in a work environment which may be more comfortably accommodated by tilting the entire seat/back arrangement 13 forwardly so that the normal upright position of the chair is forwardly tilted, such as indicated by the dotted line position in FIG. 1, then the forward tilt mechanism 19 is manually-actuated so as to selectively forwardly angularly tilt the entire seat/back arrangement 13 into the desired forwardly declined position. By manually gripping and then rotating the knob 73, this causes a corresponding axial slidable displacement of the blocklike slide 68 away from one end of the slot 67 and causes the guide blocks 69 to be slidably displaced along the slots 62 away from one end thereof. As the guide blocks 69 are progressively moved along the inclined slots 62, they cause a rotatable displacement of the surrounding tubular housing 61 in a counterclockwise direction in FIG. 1. Since the tubular housing 61 is fixedly secured to the lower seat body 22, this in turn causes a corresponding forward tilting movement of the entire seat/-back arrangement 13.

The mechanism 19 preferably provides adjustment capability so as to permit forward tilting of the seat/- back arrangement 13 through an angle of at least about 15°. Once the seat/back arrangement 13 reaches a desired forward tilt position, then the operator stops rotating the knob 73, and the mechanism 19 will remain locked in the selected position to maintain the seat/back arrangement 13 in the selected forward tilt position. This will now constitute the normal upright position of the unoccupied chair until such time as the forward tilt mechanism 19 is readjusted.

With the chair in a selected forward tilt position, such as indicated by dotted lines in FIG. 1, the chair will again be usable in a conventional manner except that the permissible rearward tilt angles of the seat and back assemblies, as permitted by the rearward tilt control 21, will now be initiated or start from the selected forward tilt position since the structure and operation of the forward tilt mechanism 19 is wholly independent of and does not effect or control the operation of the rearward tilt control 21.

Figure 8:
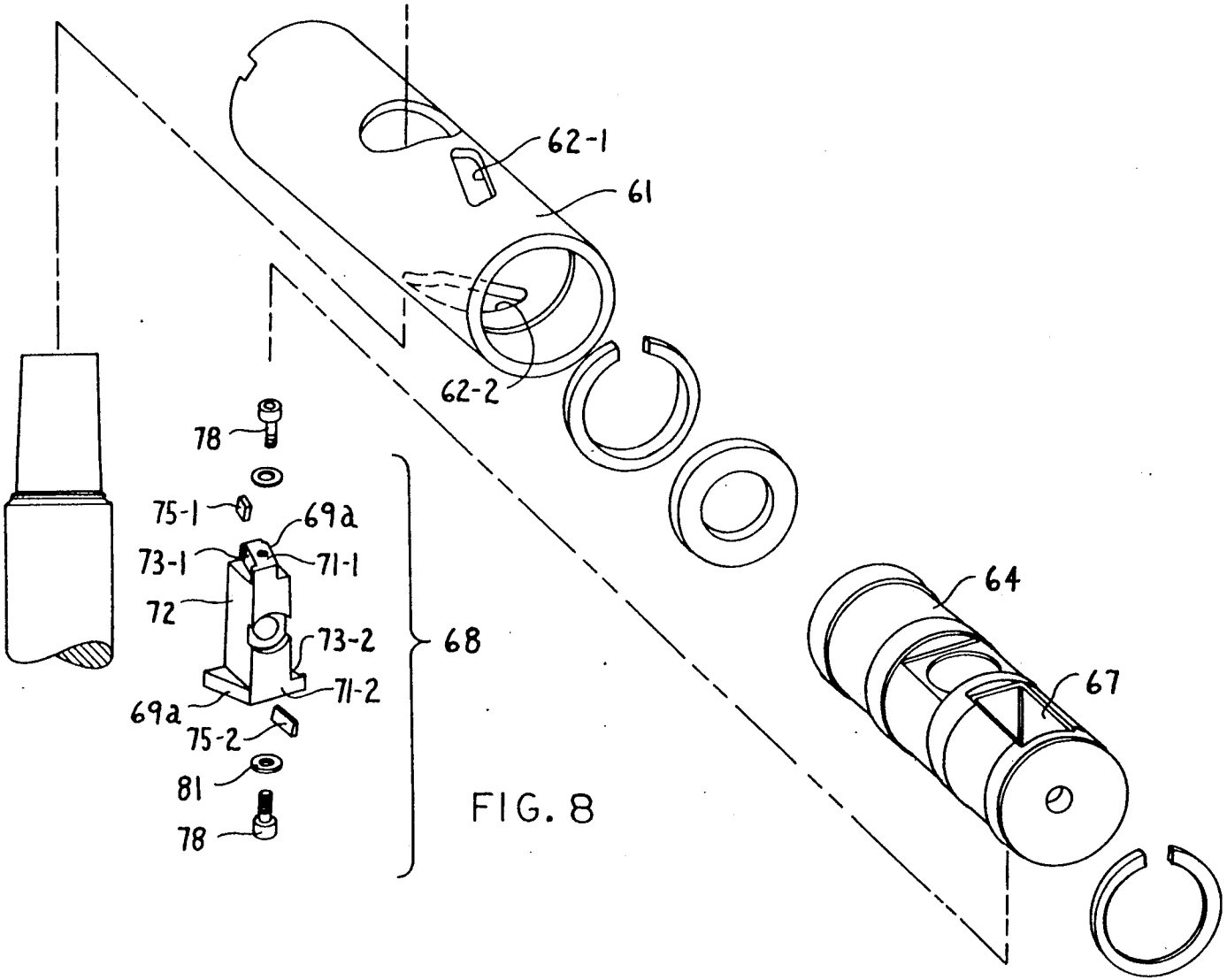
FIG. 8 is an exploded perspective view similar to FIG. 6 but illustrating a preferred variation of the invention.
Figure 9:
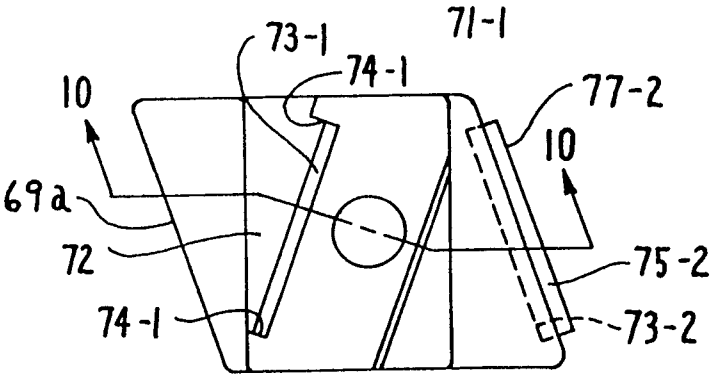
FIG. 9 is a top view of the slide associated with the variation of FIG. 8.
Figure 10:
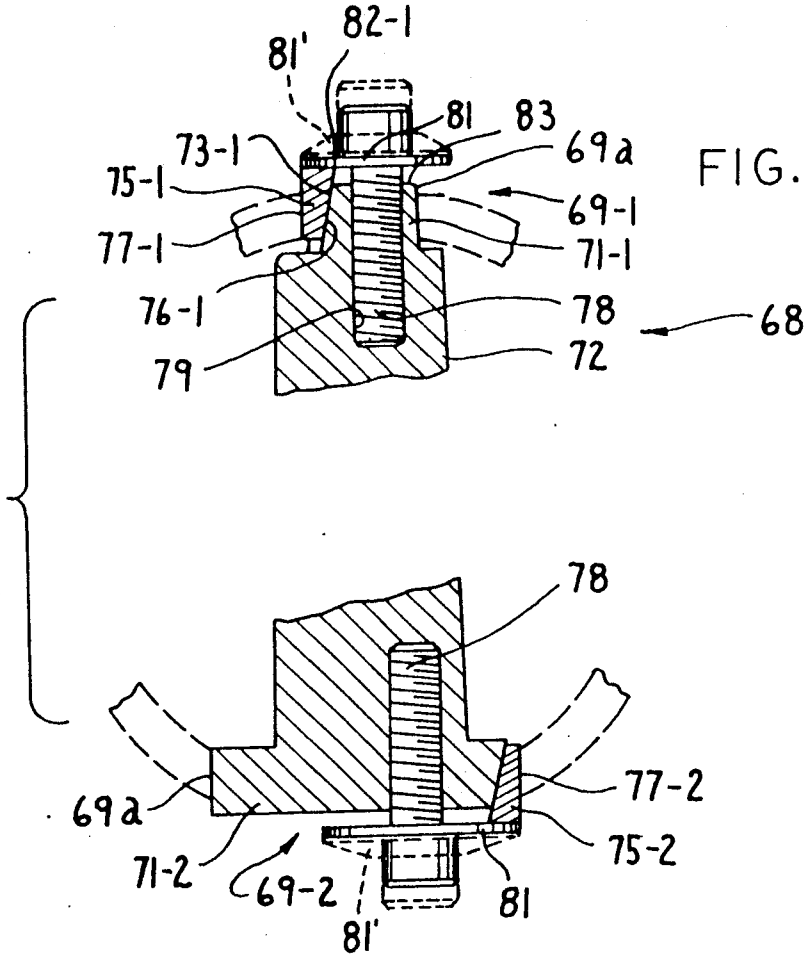
FIG. 10 is an enlarged fragmentary sectional view taken substantially along line 10—10 in FIG. 9.

Reference is now made to FIGS. 8–10 which illustrate a preferred variation of the invention, which variation relates specifically to the construction of the guide blocks associated with the tilt mechanism and their cooperation with the inclined slots so as to provide a tilt adjustment mechanism which permits relatively free axial sliding of the guide blocks along the inclined slots but which provides a mechanism which closely approaches zero clearance.

In the variation illustrated by FIGS. 8–10, corresponding parts of the overall mechanism are designated by the same reference numerals utilized above, whereby further detailed description of these parts is not repeated.

The slide 68 is again provided with guide blocks 69-1 and 69-2 associated with opposite ends thereof, which guide blocks in turn are slidably confined within the respective elongate inclined or helical slots 62-1 and 62-2 formed in the sidewall of the tubular housing 61. In this variation, the guide block 69-2 and its associated slot 62-2 have a width (that is, the dimension which extends in the circumferential direction of the tube 61) which substantially exceeds the width of the other guide block 69-1 and its associate slot 62-1, as explained hereinafter. Each of these guide blocks have generally opposite flat side surfaces which extend in generally parallel relationship to one another, and which are inclined relative to the axially extending direction of the tube 61 so as to be slidably engageable with the opposed sidewalls of the slots 62-1 and 62-2.

Each of the guide blocks 69-1 and 69-2 has an adjustment structure (described below) associated therewith for permitting the width of the respective guide block, as measured perpendicularly between the opposed side surfaces, to be adjusted so as to permit the guide block to be axially slidably confined within the respective slot 62-1 or 62-2 while still providing substantially a zero clearance between the guide block and the respective slot sidewalls.

More specifically, the guide block 69-1 includes a main portion 71-1 which is fixed, here integrally joined, to the main blocklike center portion 72 of the slide 68. This main portion 71-1 has a width (as measured in the circumferential direction of the tube 61) which is less than the width of the main center portion 72 of the slide 68. The main portion 71-1 defines one side edge surface **69*a* on one side thereof, whereas the other side is provided with a tapered groove 73-1 therein. This groove 73-1 is sloped inwardly into the width of the main part 71-1 at an angle of about ten degrees as the groove projects upwardly so as to project through the upper free end of the main part 71-1. The groove 73-1 extends longitudinally throughout a majority of the axially-extending length of main part 71-1, with the side edges of the groove being defined by shoulders or edge walls 74-1**.

A small width-adjusting wedge 75-1 (not shown in FIG. 9 for clarity of illustration) is slidably confined within the groove 73-1. This wedge has a sloped rear surface 76-1 which slidably engages the sloped wall defining the groove. The wedge also defines thereon an exposed sidewall 77-1 which cooperates with the sloped wall 76-1 so as to define a small included angle therebetween, which angle generally corresponds to the slope of the groove 73-1, such as an angle of about ten degrees. This exposed sidewall 77-1 defines an exposed side surface which extends parallel with the other side surface **69*a***.

The wedge 75-1 is slidably captivated between the edges or shoulders 74-1 so that the wedge is prevented from moving in the axial direction, and hence can move solely in a radial direction along the sloped groove 73-1. The wedge is confined in the groove by a fastening arrangement which includes a threaded fastener such as a screw 78 which treadedly engages an opening 79 formed in the main part 71, with the head of the screw bearing against an annular washer 81 which in turn bears against the top surface 82-1 of the wedge. This latter surface normally projects slightly upwardly above the exposed upper or end surface 83 of the main part 71 so as to permit the position of the wedge 75-1 to be radially adjusted with respect to the main part 71, and thereby permit adjustment in the width between the opposed side surfaces **69*a* and 77-1**.

The other guide block 69-2 is similarly constructed except that the main body part 71-2 is of greater width than the central body part 72 of the slide. The wedge 75-2 is associated with a side edge of the main body part 71-2 which is on the opposite side of the slide from the wedge 75-1 associated with the main part 71-1. The width between the opposed side surfaces **69*a* and 77-2 is substantially greater than the width between the side surfaces 69*a* and 77-1 so as to accommodate the greater width associated with the slot 62-2. Also, the parallel side surfaces 69*a* and 77-2 are oppositely inclined relative to the axial direction. Hence, the remaining corresponding parts of the guide block 69-2 will not be described but will utilized a "2" to distinguish them from the corresponding parts of the guide block 69-1** wherein the same parts are distinguish by use of a "1".

With the arrangement as described above, the cylindrical support 64 is initially slidably inserted into the tubular tilt housing 61 so that the slot 67 is substantially aligned with the inclined slots 62-1 and 62-2. The slide 68 is then inserted through the wide slot 62-2 so as to cause the center blocklike part 72 to be slidably positioned within the slot 67 while at the same time causing the main part 71-1 to be positioned within the inclined slot 62-1- The enlarged part 71-2 prevents the slide 68 from being slidably inserted totally through the slot 67. The wedges are then inserted into the respective slots and secured in position. For example, the wedge 75-2 is slidably inserted into the slot 73-2 and secured within the slot by the respective washer and screw, and in a similar fashion the other wedge 75-1 is inserted into and secured within the respective slot 73-1 by the respective washer and screw. Each threaded fastener 78 is then suitably tightened to cause the respective wedge to be slidably inserted downwardly along the respective slot until each guide block 69-1 and 69-2 occupies substantially the entire width of the respective slot 62-1 and 62-2 so as to result in substantially or approximately zero sideward clearance while still enabling the guide blocks to relatively freely slidably move lengthwise along the respective inclined slots. While this adjustment in the wedges is normally made at the time the chair is assembled, it will be appreciated that this adjustment can also be made at any subsequent time so as to adjust for wear.

As a variation, the flat washers 81 can be replaced by spring-type conical washer 81', commonly known as Belleville washers or springs, as indicated by dotted lines in FIG. 10. The spring washer 81' hence exerts a continuous resilient biasing force against the outer end of the wedge 75-1 and 75-2 so as to adjust both for wear and for variations as the guide block slides along the slot to thereby maintain a sliding fit having a substantially zero sideward clearance.

A chair incorporating the modified apparatus illustrated by FIGS. 8-10 operates in the same manner as the chair described above, whereby further detail description of the mechanism and of the tilt adjustment mode is hence believed unnecessary. This variation of the invention, however, by providing substantially zero sideward clearance between the guide blocks and the opposed sidewalls of the inclined slots, provides for improved "feel" when the chair is utilized since the chair occupant can more readily tilt the chair between positions which result in the occupant's weight shifting either forwardly or rearwardly relative to the center of the tilt mechanism without experiencing looseness in the tilt mechanism which might otherwise be sensed by the chair occupant.

While the present invention has been described above with respect to a preferred embodiment of the rearward tilt control, and while this rearward tilt control is believed to possess highly desirable and functional features, nevertheless it will be appreciated that numerous other conventional rearward tilt controls could be incorporated into the chair for use in conjunction with the improved forward tilt mechanism.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an office-type chair having a base, a cantilevered pedestal assembly projecting upwardly from substantially a center of said base, and a seat/back arrangement connected to an upper end of said pedestal assembly, said seat/back arrangement including a generally horizontally enlarged seat assembly and a back assembly projecting upwardly from and adjacent a rear edge of said seat assembly, said seat/back arrangement also including a main tilt control mechanism for permitting downwardly tilting of at least a rear portion of the seat assembly while simultaneously synchronously vertically tilting the back assembly rearwardly against the urging of a resilient biasing element, the improvement comprising a forward tilt mechanism cooperating between said pedestal assembly and said seat/back arrangement for permitting the entire seat/back arrangement to be vertically tilted forwardly away from a normal upright position into a selected one of a plurality of forward tilt positions so that said seat assembly declines in a forward direction, said forward tilt mechanism including locking means for maintaining the seat/back arrangement in the selected forward tilt position, said forward tilt mechanism being independent of said main tilt control mechanism so that the rear portion of said seat assembly and said back assembly can be synchronously downwardly and rearwardly tilted respectively away from said selected forward tilt position.

2. A chair according to claim 1, wherein said forward tilt mechanism permits said entire seat/back arrangement to be forwardly tilted throughout a continuous range of forwardly tilted angular positions, said forward tilt mechanism being self-locking throughout said continuous range of angular positions.

3. A chair according to claim 2, wherein said seat assembly includes a lower seat body positioned above said upper end of said pedestal assembly which remains in a stationary position independent of actuation of said rearward tilt control mechanism, and said forward tilt mechanism being operatively coupled between said lower seat body and said upper end of said pedestal assembly so that said lower seat body can be selectively moved into a forward tilt position upon actuation of said forward tilt mechanism.

4. A chair according to claim 3, wherein said main tilt control mechanism includes a generally L-shaped back support having an upright leg which projects upwardly into the back assembly and a lower leg which projects forwardly into said seat assembly, said lower leg being connected to said lower seat body by a generally horizontal hinge structure which defines a hinge axis which extends generally sidewardly of the seat assembly, said main tilt control mechanism also including resilient means cooperating between said lower seat body and said back support for normally resiliently urging said back support into said upright position.

5. A chair according to claim 4, wherein said seat assembly includes a generally horizontally enlarged seat pan disposed interiorly of the seat assembly, said seat pan being disposed above said lower seat body and above the lower leg of said back support, and means coupling said seat pan to said lower leg and said lower seat body for causing downward tilting of the rear portion of said seat assembly in response to rearward tilting of said back assembly.

6. A chair according to claim 5, wherein said seat pan has a narrow front strip part extending widthwise along a front edge thereof, said front strip part being fixedly secured to a front portion of said lower seat body said seat pan also having a narrow striplike flexing portion disposed directly adjacent said front strip part and extending sidewardly across the width of said pan, said pan defining an enlarged pan part located rearwardly of said flexing portion, said enlarged pan part being connected to said lower leg and said lower seat body by said coupling means.

7. A chair according to claim 6, wherein said coupling means includes a bracket fixed to said rear pan part and projecting downwardly therefrom and having an elongate slot formed therein, said slot projecting at least partially vertically and slidably accommodating therein a projecting part of said horizontal hinge structure, and a generally horizontally-elongated second slot formed in one of said bracket and lower leg for slidably accommodating therein a projection fixed to the other of said bracket and lower leg, said horizontal hinge structure being located forwardly of said pedestal assembly, and said second slot being disposed rearwardly of said horizontal hinge structure.

8. A chair according to claim 3, wherein said forward tilt mechanism includes a generally cylindrical support fixedly secured to an upper end of said pedestal mechanism and being axially elongated generally sidewardly of said seat assembly, a generally cylindrical tube fixed to said lower seat body and being axially oriented generally sidewardly of said seat assembly, said cylindrical tube being disposed in rotatable surrounding relationship to said cylindrical support, cam means cooperating between said cylindrical support and said cylindrical tube including a first cam part movably supported on said cylindrical part and cooperating with a second cam part defined on said cylindrical tube for causing rotatable displacement of said cylindrical tube around said cylindrical support in response to movement of said first cam part, and a manually-moved actuator positioned below said seat assembly and connected to said first cam part for effecting selected movement thereof.

9. A chair according to claim 8, wherein said first cam part comprises a slide which is axially slidably supported on said cylindrical support, and said second cam part comprises an inclined guide formed on said cylindrical tube.

10. A chair according to claim 9, wherein said actuator includes a rotatable spindle threadably coupled to said slide and projecting axially outwardly of said cylindrical support and being provided with a manually-engageable knob or handle on an axially outer end thereof.

11. In an office-type chair having a base, a cantilevered pedestal assembly projecting upwardly from substantially a center of said base, and a seat/back arrangement connected to an upper end of said pedestal assembly, said seat/back arrangement including a generally horizontally enlarged seat assembly and a back assembly projecting upwardly from and adjacent a rear edge of said seat assembly, said seat/back arrangement also including a rear tilt control mechanism for normally permitting at least the back assembly to be vertically tilted rearwardly against the urging of a resilient biasing element away from a normal upright position into a rearwardly tilted position, the improvement comprising a forward tilt mechanisms cooperating between said pedestal assembly and said seat assembly for permitting the entire seat/back arrangement to be vertically tilted forwardly away from said normal upright position so that said seat assembly declines in a forward direction, said forward tilt mechanism being independent of said rear tilt control, said forward tilt mechanism including a generally cylindrical support fixedly secured to an upper end of said pedestal mechanism and being axially elongated generally sidewardly of said seat assembly, a generally cylindrical tube fixed to said seat assembly and being axially oriented generally sidewardly of said seat assembly, said cylindrical tube being disposed in rotatable surrounding relationship to said cylindrical support, cam means cooperating between said cylindrical support and said cylindrical tube including a first cam part movably supported on said cylindrical part and cooperating with a second cam part defined on said cylindrical tube for causing rotatable displacement of said cylindrical tube around said cylindrical support in response to movement of said first cam part, and a manually-moved actuator positioned below said seat assembly and connected to said first cam part for effecting selected movement thereof.

12. A chair according to claim 11, wherein said first cam part comprises a slide which is axially slidably supported on said cylindrical support, and said second cam part comprises an inclined guide formed on said cylindrical tube.

13. A chair according to claim 12, wherein said actuator includes a rotatable spindle threadably coupled to said slide and projecting axially outwardly of said cylindrical support and being provided with a manually-engageable knob or handle on an axially outer end thereof.

14. A chair according to claim 12, wherein said first cam part includes means for adjusting the width thereof to substantially eliminate sideward clearance between said first cam part and the inclined guide.

15. A chair according to claim 14, wherein said inclined guide comprises an elongate slot in which said first cam part is slidably guided, said inclined slot having opposed and generally parallel side surfaces between which said first cam part is slidably confined, and said adjusting means including first and second relatively movable parts each defining a sidewall which is slidably engageable with one of the side surfaces of the slot, said first and second relatively movable parts being movable with respect to one another for varying the transverse distance between said sidewalls to substantially eliminate clearance between said sidewalls and the respectively opposed side surfaces of the slot.

16. A chair according to claim 15, wherein said first part defines a first said sidewall thereon, said first part defining a wedgelike groove on an opposite side thereof, and said second part comprising a wedgelike member slidably confined within said groove and defining thereon a second said sidewall, and means cooperating with said first and second parts for coupling said wedgelike member to said first part while permitting slidable adjustment of said wedgelike member relative to said first part to vary the transverse spacing between said first and second sidewalls.

17. In an office-type chair having a base, a cantilevered pedestal assembly projecting upwardly from substantially a center of said base, and a seat/back arrangement connected to an upper end of said pedestal assembly, said seat/back arrangement including a generally horizontally enlarged seat assembly and a back assembly projecting upwardly from and adjacent a rear edge of said seat assembly, the improvement comprising a front tilt mechanism cooperating between said pedestal assembly and said seat assembly for permitting the entire seat/back arrangement to be vertically tilted forwardly away from a normal upright position so that said seat assembly declines in a forward direction, said forward tilt mechanism including a generally cylindrical support fixedly secured to an upper end of said pedestal mechanism and being axially elongated generally sidewardly of said seat assembly, a generally cylindrical tube fixed to said seat assembly and being axially oriented generally sidewardly of said seat assembly, said cylindrical tube being disposed in rotatable surrounding relationship to said cylindrical support, cam means cooperating between said cylindrical support and said cylindrical tube including a first cam part movably supported on said cylindrical part and cooperating with a second cam part defined on said cylindrical tube for causing rotatable displacement of said cylindrical tube around said cylindrical support in response to movement of said first cam part, a manually-moved actuator positioned below said seat assembly and connected to said first cam part for effecting selected movement thereof, said first cam part comprising a slide which is axially slidably supported on said cylindrical support, said second cam part comprising an inclined guide formed on said cylindrical tube, and said first cam part including means for adjusting the width thereof to substantially eliminate sideward clearance between said first cam part and the inclined guide.

18. A chair according to claim 17, wherein said inclined guide comprises an elongate slot in which said first cam part is slidably guided, said inclined slot having opposed and generally parallel side surfaces between which said first cam part is slidably confined, and said adjusting means including first and second relatively movable parts each defining a sidewall which is slidably engageable with one of the side surfaces of the slot, said first and second relatively movable parts being movable with respect to one another for varying the transverse distance between said sidewalls to substantially eliminate clearance between said sidewalls and the respectively opposed side surfaces of the slot.

19. A chair according to claim 18, wherein said first part defines a first said sidewall thereon, said first part defining a wedgelike groove on an opposite side thereof, and said second part comprising a wedgelike member slidably confined within said groove and defining thereon a second said sidewall, and means cooperating with said first and second parts for coupling said wedgelike member to said first part while permitting slidable adjustment of said wedgelike member relative to said first part to vary the transverse spacing between said first and second sidewalls.

20. A chair according to claim 19, wherein said cooperating means includes spring means for normally urging said wedgelike member along said wedgelike groove so as to substantially eliminate sideward clearance between said wedgelike member and said inclined guide.

* * * * *